US009518585B2

(12) United States Patent
Choi et al.

(10) Patent No.: US 9,518,585 B2
(45) Date of Patent: Dec. 13, 2016

(54) FAN

(71) Applicant: LG ELECTRONICS INC., Seoul (KR)

(72) Inventors: Seokho Choi, Seoul (KR); Yongcheol Sa, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 493 days.

(21) Appl. No.: 14/024,197

(22) Filed: Sep. 11, 2013

(65) Prior Publication Data

US 2014/0072435 A1 Mar. 13, 2014

(30) Foreign Application Priority Data

Sep. 12, 2012 (KR) ..... 10-2012-0101073

(51) Int. Cl.

*F04D 29/38* (2006.01)
*F04D 29/66* (2006.01)
*F04D 19/00* (2006.01)

(52) U.S. Cl.

CPC ..... *F04D 19/002* (2013.01); *F04D 29/384* (2013.01); *F04D 29/663* (2013.01); *F04D 29/666* (2013.01); *F05D 2240/304* (2013.01)

(58) Field of Classification Search

CPC .... F04D 29/384; F04D 29/666; F04D 29/667; F04D 29/663; F04D 19/002; F05B 2240/30; F05B 2240/301; F05B 2260/96; F05B 2260/962; F05B 2240/304

USPC .. 415/119; 416/228, 235, 236 R, 236 A, 237

See application file for complete search history.

(56) References Cited

U.S. PATENT DOCUMENTS

| | | | | |
|---|---|---|---|---|
| 2,238,749 | A * | 4/1941 | Peltier | F04D 29/38 415/119 |
| 2,899,128 | A | 8/1959 | Vaghi | 230/117 |
| 4,089,618 | A | 5/1978 | Patel | |
| 5,533,865 | A * | 7/1996 | Dassen | F03D 1/0608 244/200 |
| 5,603,607 | A * | 2/1997 | Kondo | F04D 29/384 415/119 |
| 2007/0177971 | A1* | 8/2007 | Teraoka | F04D 29/283 415/53.1 |
| 2009/0028719 | A1* | 1/2009 | Teraoka | F04D 17/04 416/223 R |
| 2010/0266428 | A1* | 10/2010 | Nakagawa | F04D 29/164 417/321 |

(Continued)

FOREIGN PATENT DOCUMENTS

| | | |
|---|---|---|
| CN | 101344014 A | 1/2009 |
| EP | 0 711 925 A1 | 5/1996 |

(Continued)

OTHER PUBLICATIONS

Chinese Office Action dated Jul. 31, 2015 issued in Application No. 201310346604.7 (Full English Text).

(Continued)

*Primary Examiner* — Christopher Verdier
(74) *Attorney, Agent, or Firm* — Ked & Associates, LLP

(57) ABSTRACT

Provided is a fan. The fan includes a hub and a blade extending from the hub. The blade includes a blade rear end having a predetermined curvature and a blade side end connected to the blade rear end. The blade rear end includes ridge parts protruding in a predetermined direction from an extension and furrow parts protruding in a direction opposite to the predetermined direction.

8 Claims, 8 Drawing Sheets

(56) References Cited

U.S. PATENT DOCUMENTS

2013/0091888 A1* 4/2013 Park ..... F04D 29/384
62/426

FOREIGN PATENT DOCUMENTS

| | | | |
|---|---|---|---|
| EP | 1 277 966 | A2 | 1/2003 |
| EP | 2 014 870 | A2 | 1/2009 |
| JP | 2012-136944 | | 7/2012 |

OTHER PUBLICATIONS

European Search Report dated Jan. 7, 2014 issued in Application No. 13 18 3726.
Chinese Office Acton dated Aug. 18, 2016 issued in Application No. 201310346604.7.

* cited by examiner

FAN

CROSS-REFERENCE TO RELATED APPLICATION

The present application claims priority under 35 U.S.C. §119 to Korean Patent Application No. 10-2012-0101073 filed on Sep. 12, 2012, which is hereby incorporated by reference in its entirety.

BACKGROUND

1. Field

The present disclosure relates to a fan.

2. Background

Generally, in an air conditioner, indoor or outdoor air is blown by a fan, and the blown air exchanges heat with refrigerant flowing in an evaporator or coolant flowing in a heater. Air cooled or heated through such heat exchange is blown into an indoor area for cooling or heating the indoor area.

FIG. 1 is a perspective view illustrating a fan 1 of the related art.

Referring to FIG. 1, the fan 1 of the related art includes: a hub 10 that may be connected to a motor; and a plurality of blades 20 extending from the hub 10. The blades 20 have positive-pressure surfaces 24 and negative-pressure surfaces 25 opposite to the positive-pressure surfaces 24.

Air stream on the blades 20 will now be explained.

Referring to FIG. 1, if the blades 20 are rotated counter-clockwise, air flows on rear surfaces of the blades 20 and is separated therefrom. Due to the separation of air, noise is generated.

Recently, large-capacity air conditioning systems are widely used, and such large-capacity air conditioning systems require high air flow rates. If the air flow rate of an air conditioning system is high, more noise is generated when air flows through a fan. Such noise of a fan annoys users.

Embodiments provide a fan in which less air-stream noise is generated from blades.

In one embodiment, a fan comprises a hub and a blade extending from the hub. The blade comprises a blade rear end having a predetermined curvature and a blade side end connected to the blade rear end. The blade rear end comprises an alternating pattern of ridge parts and groove parts, the pattern extending along the edge of the blade rear end. For example, the alternating pattern of ridge parts and groove parts provides an overall wave shape or meandering shape of the blade rear end.

The ridge parts and the groove parts may extend from the blade in opposite directions in the area of the blade rear end.

For example, the ridge parts protrude in a predetermined direction from an extension and the groove parts protrude in a direction opposite to the predetermined direction. Herein, the extension may be an imaginary line connected from a first point at which the hub and the blade rear end meet to a second point at which the blade side end and the blade rear end meet.

The ridge parts and the groove parts may be rounded with predetermined curvatures.

The ridge parts and the groove parts may be alternately arranged so that sounds generating from air flowing on the ridge parts and the groove parts cancel out each other.

A distance between adjacent two of the ridge parts is preferably equal to a distance between adjacent two of the groove parts.

The alternating pattern may comprise a first connection part extending from a first upper end part of the pattern to a first lower end part of the pattern being next to the first upper end part, and a second connection part extending from a second upper end part of the pattern being next to the first upper end part to the first lower end part of the pattern.

The first connection part may be in contact with the second connection part.

The first upper end part and the second upper end part may be pointed end parts.

The first lower end part may have a width D between the first connection part and the second connection part. The first upper end part may have a width C being equal to the width D of the first lower end part.

The details of one or more embodiments are set forth in the accompanying drawings and the description below. Other features will be apparent from the description and drawings, and from the claims.

BRIEF DESCRIPTION OF THE DRAWINGS

The embodiments will be described in detail with reference to the following drawings in which like reference numerals refer to like elements wherein.

DETAILED DESCRIPTION

Figure 1:
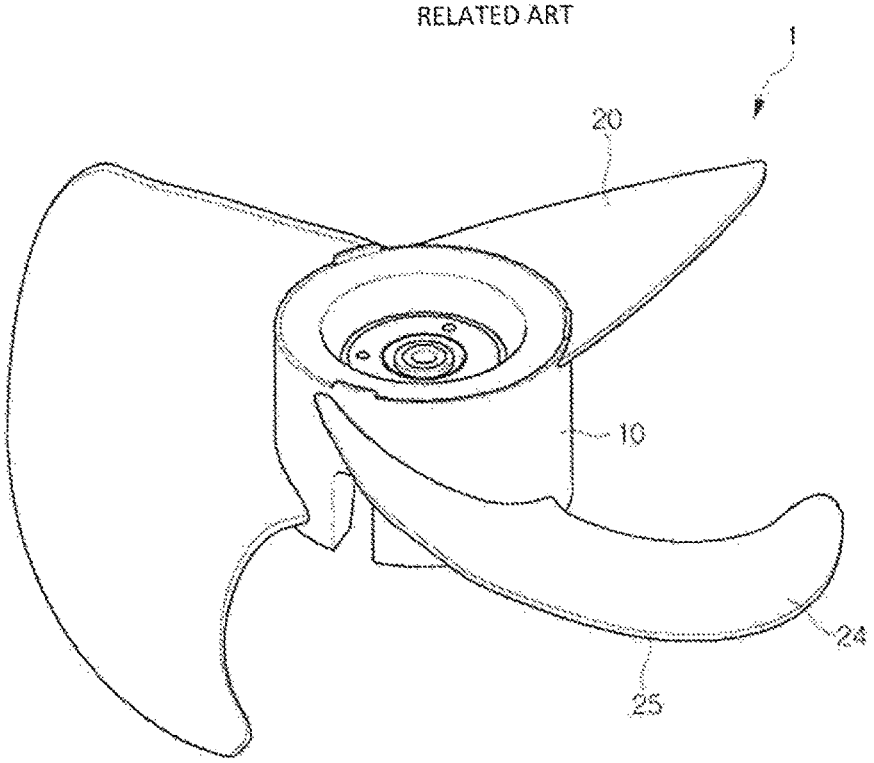
FIG. 1 RELATED ART
FIG. 1 is a perspective view illustrating a fan of the related art.

Hereinafter, embodiments will be explained with reference to the accompanying drawings. In the drawings, like elements may be denoted by like reference numerals. Moreover, detailed descriptions related to well-known functions or configurations will be ruled out in order not to unnecessarily obscure subject matters of the embodiments.

Figure 2:
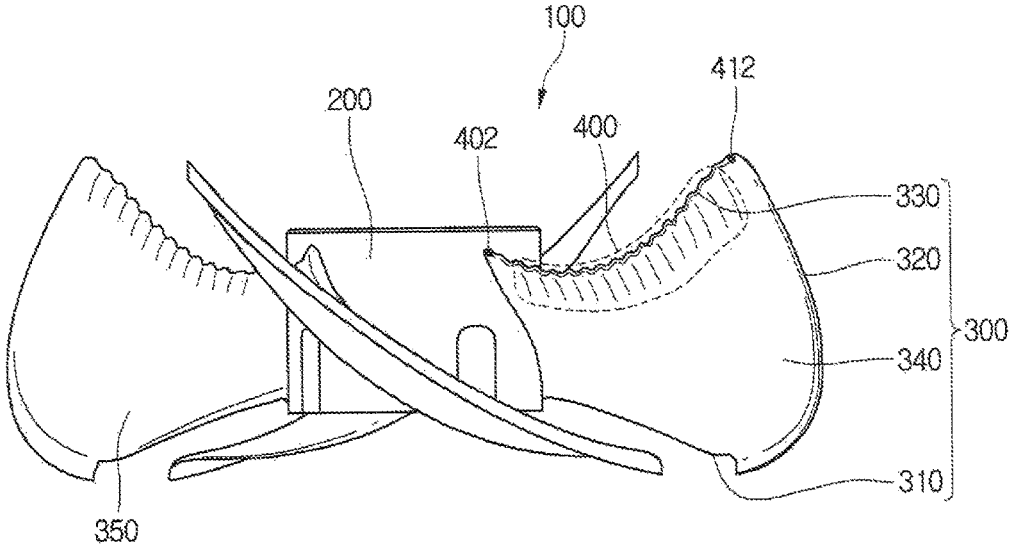
FIG. 2 is a side view illustrating a fan according to an embodiment.
Figure 3:
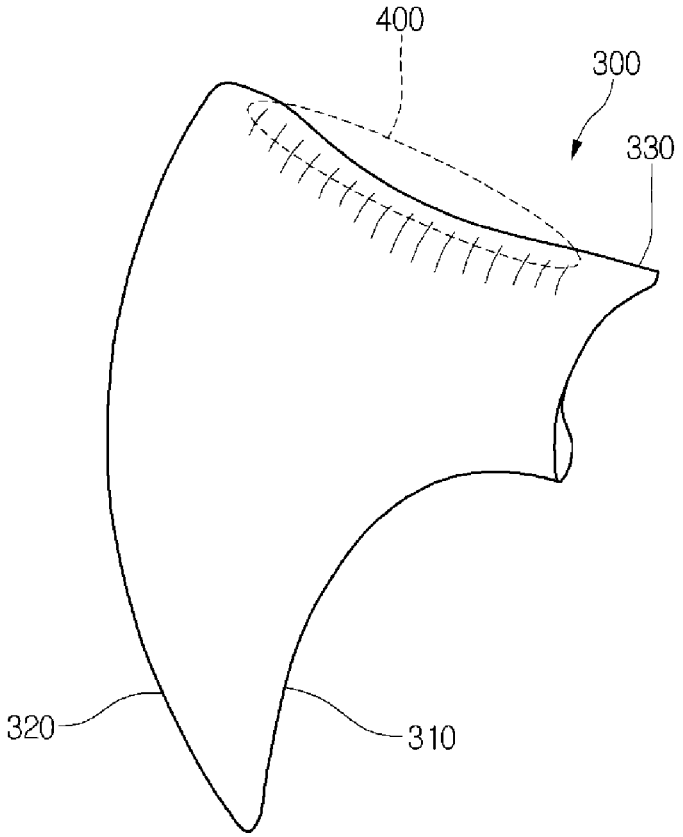
FIG. 3 is a view illustrating a side of a blade according to an embodiment.

FIG. 2 is a side view illustrating a fan 100 according to an embodiment, and FIG. 3 is a view illustrating a side of a blade 300 according to an embodiment.

Referring to FIGS. 2 and 3, the fan 100 of the embodiment includes: a hub 200 that may be connected to a motor and rotated by the motor; and a plurality of blades 300 extending the hub 200. The blades 300 may be arranged at regular intervals. The number and shape of the blades 300 are not limited.

Each of the blades 300 includes: a blade front end (edge) 310 having a predetermined curvature; a blade side end (edge) 320 extending from the blade front end 310 for forming the lateral side of the blade 300; and a blade rear end (edge) 330 extending from the blade side end 320.

The blade rear end 330 may have an extension 411 (refer to FIG. 4) which is an imaginary line connected from a first point 402 at which the hub 200 and the blade rear end 330 meet to a second point 412 at which the blade side end 320 and the blade rear end 330 meet (see FIG. 2).

A noise prevention part 400 is provided on the extension 411 (refer to FIG. 4) to minimize air-stream noise.

Each of the blades 300 has a positive-pressure surface 350 and a negative-pressure surface 340 opposite to the positive-pressure surface 350. Air flowing on the negative-pressure surface 340 is separated from the negative-pressure surface 340 at a rear end of the negative-pressure surface 340, which may cause noise.

Hereinafter, a detailed explanation will be given on an air stream along the negative-pressure surface 340.

The hub 200 may be rotated in one direction by a motor. As the hub 200 is rotated, air makes contact with the blade front end 310 and then flows on the negative-pressure surface 340 to the blade rear end 330.

When air flows from the blade front end 310 to the blade rear end 330, the air flowing on the negative-pressure surface 340 is separated from the negative-pressure surface 340 at a position near the blade rear end 330. This may be referred to as air separation.

If air separation occurs, pressure on the blade 300 varies, and such pressure variation generates noise. However, according to the invention, generation of noise can be reduced owing to the noise prevention part 400 provided on the negative-pressure surface 340.

Hereinafter, the characteristic part of the embodiment, that is, the noise prevention part 400 will be described in detail.

Figure 4:
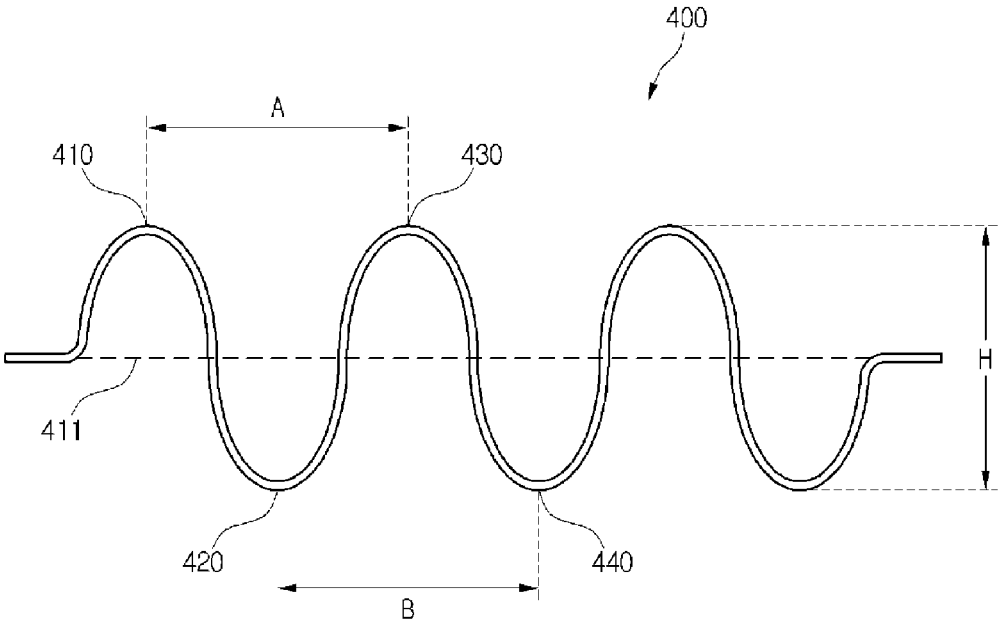
FIG. 4 is a rear view illustrating a blade rear end according to a first embodiment.

FIG. 4 is a rear view illustrating the blade rear end 330 according to a first embodiment.

Referring to FIG. 4, the noise prevention part 400 may have the extension 411 which is an imaginary line connected from the first point 402 at which the hub 200 and the blade rear end 330 meet to the second point 412 at which the blade side end 320 and the blade rear end 330 meet.

The noise prevention part 400 includes: a plurality of ridge parts 410 and 430 protruding upward from the extension 411; and a plurality of groove or furrow parts 420 and 440 protruding downward from the extension 411. The ridge parts 410 and 430 and the furrow parts 420 and 440 may be alternately arranged.

The ridge parts 410 and 430 and the groove parts 420 and 440 may be rounded with predetermined curvatures. The predetermined curvatures may be equal or different. That is, the curvature of the ridge parts may be different from the curvature of the groove parts.

If the ridge part adjacent or next to the hub 200 is referred to as a first ridge part 410 and the groove part adjacent or next to the first ridge part 410 is referred to as a first groove part 420, the vertical distance between the first ridge part 410 and the first groove part 420 may be H. Then, the vertical distance between the first ridge part 410 and the extension 411 may be H/2. However, the vertical distance between the first ridge part 410 and the extension 411 is not limited thereto. For example, the vertical distance between the first ridge part 410 and the extension 411 may be 2H/3, and the vertical distance between the first groove part 420 and the extension 411 may be H/3. In other words, the grooves and the ridges may have equal or different heights.

If the ridge part adjacent to the first ridge part 410 is referred to as a second ridge part 430 and the groove part adjacent to the first groove part 420 is referred to as a second groove part 440, the vertical distance between the second ridge part 430 and the second furrow part 440 may be H. However, the vertical distance between the second ridge part 430 and the second furrow part 440 is not limited thereto. That is, the vertical distance between the first ridge part 410 and the first groove part 420 may be equal to or different from the vertical distance between the second ridge part 430 and the second groove part 440.

The distance between the peaks of ridge parts may be equal to or different from the distance between the peaks of the groove parts. For example, if the distance between the first ridge part 410 and the second ridge part 430 is A and the distance between the first groove part 420 and the second groove part 440 is B, the distances A and B may be equal or different.

According to the embodiment, owing to the noise prevention part 400 on the blade rear end 330, generation of noise can be suppressed. Noise is a kind of sound, and every sound is a series of waves.

Hereinafter, an explanation will be given of how the noise prevention part 400 can reduce noise at the blade 300.

Figure 5:
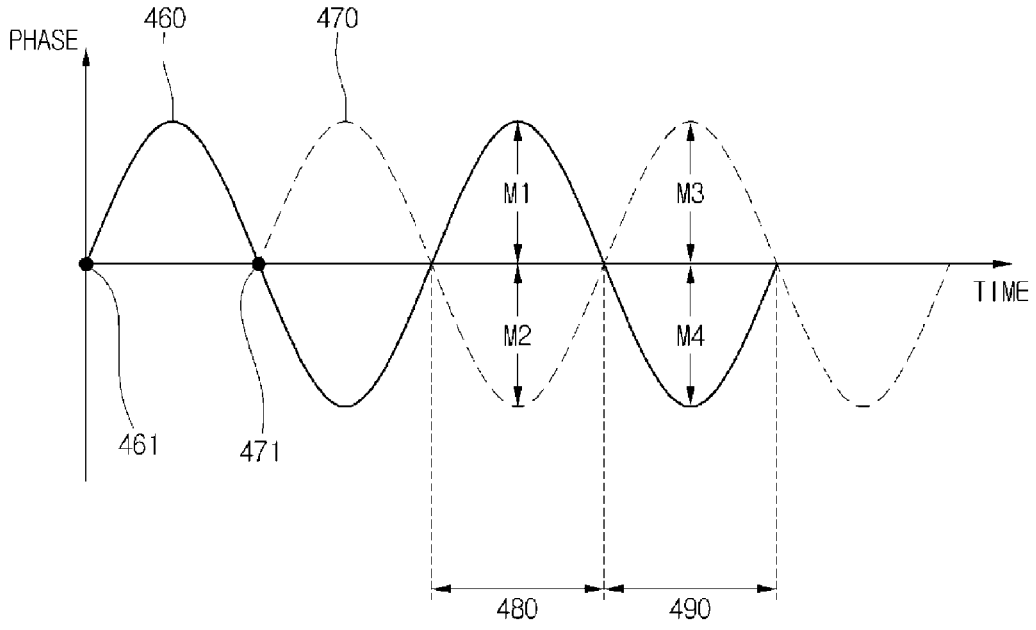
FIG. 5 is a graph for explaining waves of air flowing on the blade rear end according to the first embodiment.

FIG. 5 is a graph for explaining waves of air flowing on the blade rear end according to the first embodiment.

An explanation will now be given with reference to FIG. 5. As described above, the noise prevention part 400 includes a plurality of ridge parts and a plurality of groove parts, and the ridge parts and the groove parts are alternately arranged. Therefore, when air flows on the ridge parts and the groove parts, different waves are generated in the air. In detail, waves are generated in air flowing on the ridge parts at points of time different from points of time at which waves are generated in air flowing on the groove parts.

For example, it may be assumed that waves generating in air flowing on the ridge parts have the same shape as that of waves generating in air flowing on the groove parts. Specifically, first waves 460 may be generated in air flowing on the ridge parts, and second waves 470 may be generated in air flowing on the groove parts.

On the other hand, first waves 460 may be generated in air flowing on the groove parts, and second waves 470 may be generated in air flowing on the ridge parts.

The first waves 460 may start at a first point 461, and the second waves 470 may start at a second point 471. That is, the first and second waves 460 and 470 may have the same wavelength and waveform except that the first and second waves 460 and 470 are out of phase.

An explanation will now be given of how noises can be reduced by the characteristic part of the embodiment, that is, by the noise prevention part 400.

First, referring to a first period 480, the amplitude of the first waves 460 is denoted by +M1, and the phase of the second waves 470 is denoted by −M2. If M1 and M2 are equal, a sound by the first waves 460 may be canceled out by a sound by the second waves 470. That is, since the first waves 460 and the second waves 470 are out of phase, sounds may destructively interfere with each other.

Referring to a second period 490, the amplitude of the first waves 460 is denoted by −M4, and the phase of the second waves 470 is denoted by +M3. If M3 and M4 are equal, a sound by the second waves 470 may be canceled out by a sound by the first waves 460. That is, sounds may destructively interfere with each other.

As described above, according to the embodiment, noises generating at the ridge parts destructively interfere with noises generating at the furrow parts, and thus the generation of noise at the blade may be reduced.

Hereinafter, another exemplary noise prevention part different from the noise prevention part 400 of the first embodiment will be described according to another embodiment. In the following description, the structure of the other noise prevention part will be mainly explained because the concept for preventing noise is not changed as compared with the first embodiment.

Figure 6:
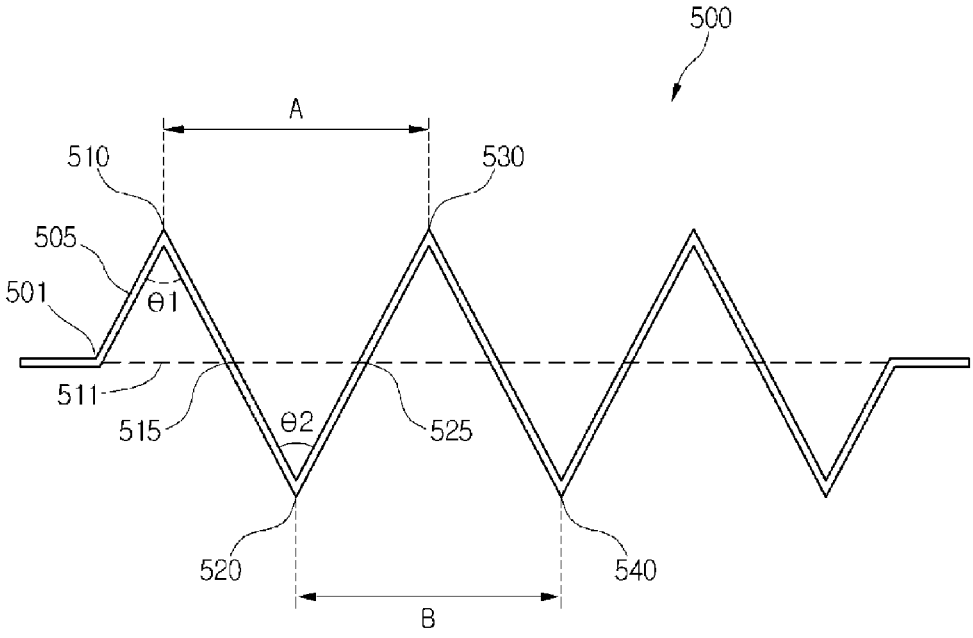
FIG. 6 is a rear view illustrating a blade rear end according to a second embodiment.

FIG. 6 is a rear view illustrating a blade rear end according to a second embodiment.

Referring to FIG. 6, a noise prevention part 500 includes: a plurality of ridge parts 510 and 530 protruding upward from an extension 511; and a plurality of groove parts 520 and 540 protruding downward from the extension 511. The ridge parts 510 and 530 and the groove parts 520 and 540 may be alternately arranged.

If a point of the extension 511 from which the ridge parts 510 and 530 start is referred to as an initial point 501 and the ridge part 510 closest to the hub 200 is referred to as a first ridge part 510, a ridge part slope 505 may be defined between the initial point 501 and the first ridge part 510. If the groove part closest to the first ridge part 510 is referred to as a first groove part 520, a first connection part 515 may be defined between the first ridge part 510 and the first groove part 520.

The angle between the ridge part slope 505 and the first connection part 515 may be θ1.

Since the first ridge part 510 is an uppermost part from the extension 511, the first ridge part 510 may be referred to as a first upper end part.

In addition, if the ridge part adjacent to the first ridge part 510 is referred to as a second ridge part 530 and the groove part adjacent to the first groove part 520 is referred to as a second groove part 540, a second connection part 525 may be defined between the first groove part 520 and the second ridge part 530. The angle between the first connection part 515 and the second connection part 525 may be θ2.

Since the second ridge part 530 is adjacent to the first upper end part and is higher than the extension 511, the second ridge part 530 may be referred to as a second upper end part. In addition, since the first groove part 520 is a lowermost part from the extension 511, the first furrow part 520 may be referred to as a first lower end part. A plurality of upper end parts and a plurality of lower end parts may be provided.

A side of the first connection part 515 and a side of the second connection part 525 may be in contact with each other. The first upper end part may be a pointed end part.

The angles θ1 and θ2 may be equal or different. A distance A between neighboring ridge parts may be equal to or different from a distance B between neighboring furrow parts. However, the angles θ1 and θ2 and the distances A and B are not limited thereto.

Figure 7:
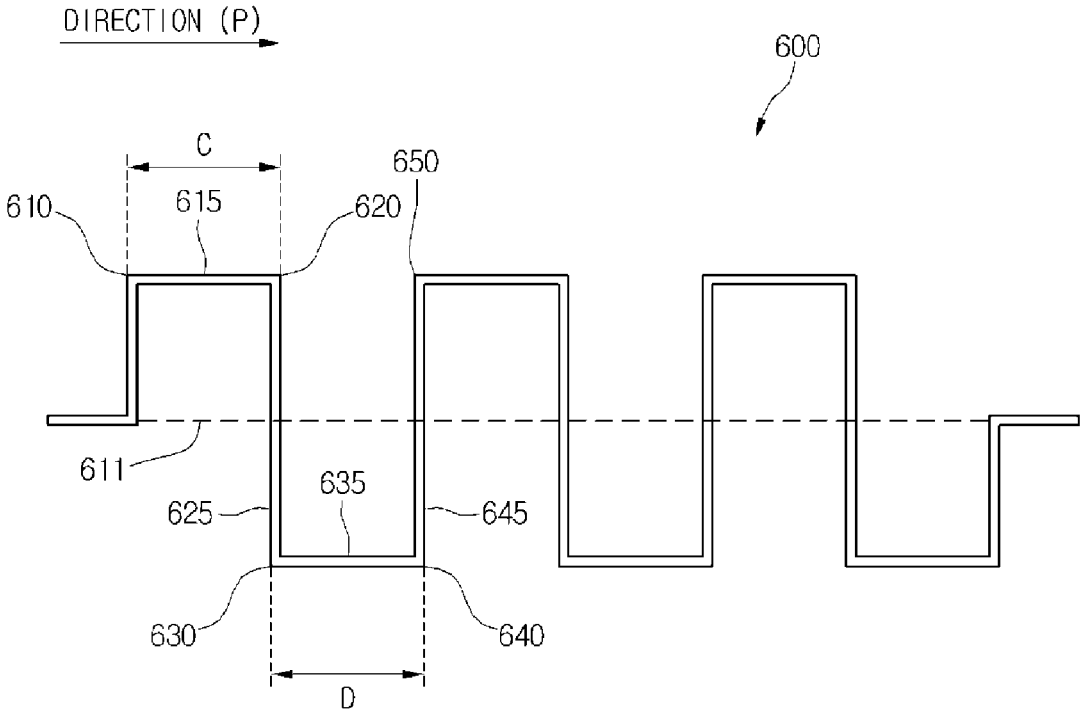
FIG. 7 is a rear view illustrating a blade rear end according to a third embodiment.
Figure 8:
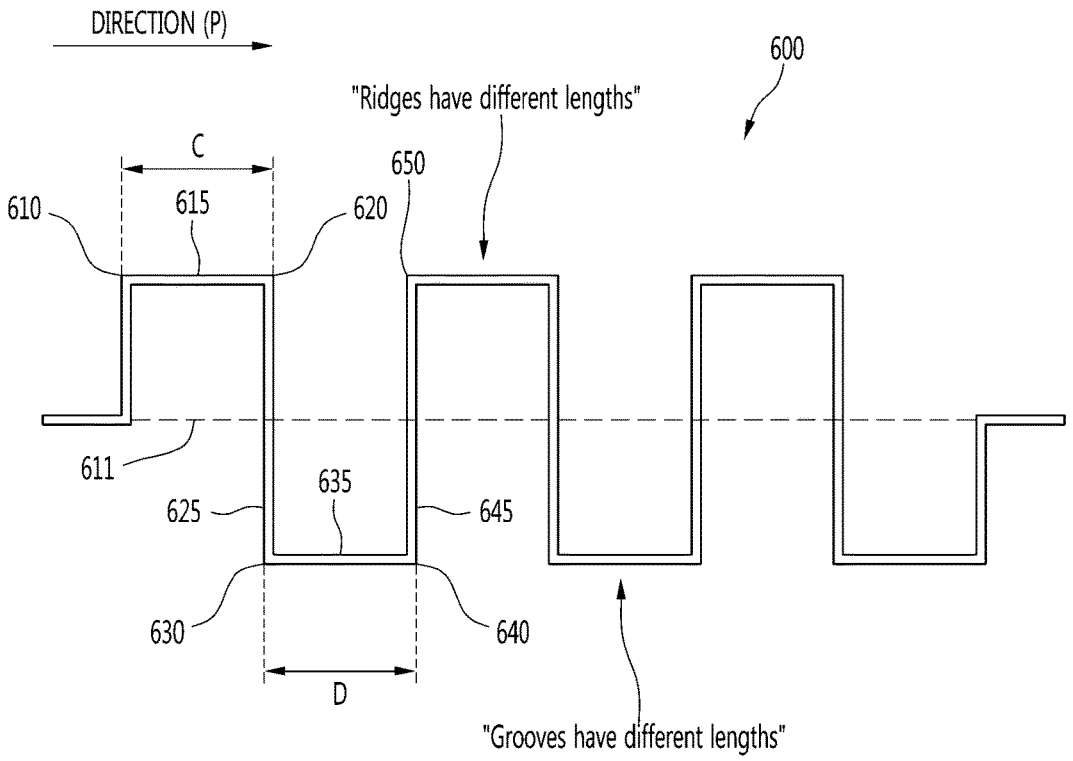
FIG. 8 is a rear view illustrating a blade rear end according to a forth embodiment.

FIG. 7 is a rear view illustrating a blade rear end according to a third embodiment.

Referring to FIG. 7, a noise prevention part 600 includes: a plurality of ridge parts 610 and 620 protruding upward from an extension 611; and a plurality of groove parts 630 and 640 protruding downward from the extension 611. The ridge parts 610 and 620 and the groove parts 630 and 640 may be alternately arranged.

If the ridge part closest to the hub 200 is referred to as a first ridge part 610 and the ridge part closest to the first ridge part 610 is referred to as a second ridge part 620, a first upper end part 615 may be defined between the first ridge part 610 and the second ridge part 620.

If the groove part closest to the second ridge part 620 is referred to as a first groove part 630 and the groove part closest to the first groove part 630 is referred to as a second groove part 640, a first lower end part 635 may be defined between the first groove part 630 and the second groove part 640. A plurality of upper end parts and a plurality of lower end parts may be provided.

The length of the first upper end part 615 may be C. The length of the first lower end part 635 may be D. The lengths C and D may be equal or different. For example, the length C of the first upper end part 615 may be greater or shorter than the length D of the first lower end part 635. However, the lengths C and D are not limited thereto.

A first connection part 625 may be vertically connected from a side of the first upper end part 615 to an end of the first lower end part 635. If the ridge part closest to the second groove part 640 is referred to a third ridge part 650, a second connection part 645 may connect the third ridge part 650 to the second groove part 640.

The first connection part 625 and the second connection part 645 may have the same length or different lengths. A side of the first connection part 625 and a side of the second connection part 645 may be connected to both ends of the first lower end part 635.

Unlike in FIG. 7, the upper end parts and the lower end parts may be formed by a combination of curves and lines. For example, the first ridge part 610 may be upwardly curved in a direction P from the first ridge part 610 to the second ridge part 620. Then, a linear line may be connected to the curved first ridge part 610 in the direction P from the first ridge part 610 to the second ridge part 620. Thereafter, near the second ridge part 620, a downwardly curved line may be connected to an end of the linear line.

The ridge parts and groove parts are not limited thereto. For example, the ridge parts and furrow parts may be variously shaped or constructed in other embodiments.

According to the embodiments, the stiffness of the blade rear end can be maintained because the height of the blade rear end is periodically varied. In addition, since waves generating when air flows on the blades are out of phase, less noise is generated from the blades.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A fan, comprising:

a hub; and a plurality of blades that extends from the hub, each of the plurality of blades including a positive-pressure surface and a negative-pressure surface opposite to the positive-pressure surface, wherein each of the plurality of blades includes a blade rear end having a predetermined curvature and a blade side end connected to die blade rear end, wherein the blade rear end includes an alternating pattern of ridges and grooves, the pattern extending along an edge of the blade rear end, wherein the ridges protrude different lengths from the positive-pressure surface and the grooves protrude different lengths from the negative-pressure surface, and wherein the ridges and the grooves have square ends.

2. The fan according to claim 1, wherein the ridges and the grooves are alternately arranged so that sounds generating from air flowing on the ridges and the grooves cancel out each other.

3. The fan according to claim 1, wherein a distance between an adjacent two of the ridges is equal to a distance between an adjacent two of the grooves.

4. The fan according to claim 1, wherein the alternating pattern includes:

a first connection portion that extends from a first upper end of the pattern to a first lower end of the pattern being next to the first upper end; and a second connection portion that extends from a second upper end of the pattern being next to the first upper end to the first lower end of the pattern.

5. The fan according to claim 4, wherein the first connection portion is in contact with the second connection portion.

6. A fan, comprising:

a hub; and a plurality of blades that extends from the hub, each of the plurality of blades including a positive-pressure surface and a negative-pressure surface opposite to the positive-pressure surface, wherein each of the plurality of blades includes a blade rear end having a predetermined curvature and a blade side end connected to the blade rear end, wherein the blade rear end includes an alternating pattern of ridges and grooves, the pattern extending along an edge of the blade rear end, wherein the ridges protrude different lengths from the positive-pressure surface and the grooves protrude different lengths from the negative-pressure surface, wherein the alternating pattern includes:

a first connection portion that extends from a first upper end of the pattern to a first lower end of the pattern being next to the first upper end; and a second connection portion that extends from a second upper end of the pattern being next to the first upper end to the first lower end of the pattern, wherein the first lower end has a width between the first connection portion and the second connection portion, and wherein the ridges and the grooves have square ends.

7. The fan according to claim 6, wherein the first upper end has a width equal to a width of the first lower end.

8. A fan, comprising:

a hub; and a plurality of blades that extends from the hub, each of the plurality of blades having a positive-pressure surface and a negative-pressure surface opposite to the positive-pressure surface, wherein each of the plurality of blades includes a blade rear end having a predetermined curvature and a blade side end connected to the blade rear end, wherein the blade rear end includes:

an extension, which is an imaginary line connected from a first point at which the hub and the blade rear end meet to a second point at which the blade side end and the blade rear end meet; and an alternating pattern of ridges and grooves, the pattern extending along the extension, wherein the ridges protrude different lengths from the positive-pressure surface and the grooves protrude different lengths from the negative-pressure surface, and wherein the ridges and the grooves have square ends.

* * * * *